US011105478B1

(12) United States Patent
Ding

(10) Patent No.: US 11,105,478 B1
(45) Date of Patent: Aug. 31, 2021

(54) FLAMELESS CANDLE

(71) Applicant: Nantong Ya Tai Candle Arts & Crafts Co., Ltd., Nantong (CN)

(72) Inventor: Yingqi Ding, Nantong (CN)

(73) Assignee: NANTONG YA TAI CANDLE ARTS & CRAFTS CO., LTD., Nantong (CN)

( * ) Notice: Subject to any disclaimer, the term of this patent is extended or adjusted under 35 U.S.C. 154(b) by 0 days.

(21) Appl. No.: 16/993,318

(22) Filed: Aug. 14, 2020

(30) Foreign Application Priority Data

Jul. 28, 2020 (CN) ..... 202010737946.1

(51) Int. Cl.

| | |
|---|---|
| ***F21S 10/04*** | (2006.01) |
| ***F21S 9/00*** | (2006.01) |
| ***F21V 23/04*** | (2006.01) |
| *F21S 10/00* | (2006.01) |

(52) U.S. Cl.
CPC ..... *F21S 10/043* (2013.01); *F21S 9/00* (2013.01); *F21V 23/04* (2013.01); *F21S 10/00* (2013.01); *F21S 10/04* (2013.01)

(58) Field of Classification Search
CPC ..... F21S 10/00; F21S 10/04; F21S 10/043; F21V 23/04; F21Y 2115/10
See application file for complete search history.

(56) References Cited

U.S. PATENT DOCUMENTS

| | | | | |
|---|---|---|---|---|
| 6,346,777 | B1 * | 2/2002 | Kim | H05B 45/395 315/185 S |
| 9,719,643 | B1 * | 8/2017 | Cheng | F21S 6/001 |
| 10,443,798 | B1 * | 10/2019 | Tan | F21S 10/046 |
| 2002/0071279 | A1 * | 6/2002 | Katogi | H05B 45/20 362/317 |
| 2011/0204828 | A1 * | 8/2011 | Moody | H05B 47/16 315/360 |
| 2015/0219287 | A1 * | 8/2015 | Wassel | F21K 9/60 362/243 |
| 2017/0211766 | A1 * | 7/2017 | Li | F21S 10/04 |
| 2017/0370541 | A1 * | 12/2017 | Huang | F21S 10/046 |
| 2018/0347772 | A1 * | 12/2018 | Lin | F21S 6/001 |
| 2020/0217469 | A1 * | 7/2020 | Fan | F21S 10/046 |

* cited by examiner

*Primary Examiner* — Zheng Song
(74) *Attorney, Agent, or Firm* — Matthias Scholl P.C.; Matthias Scholl

(57) ABSTRACT

A flameless candle including a first housing, a flame body, a lamp bead, and a power source. The flame body is disposed on one end of the first housing and includes a lamp holder and a flame head disposed on the lamp holder. The first housing includes a cavity and the power source is disposed in the cavity. The lamp bead includes a second housing, at least two light-emitting elements, and a circuit board. The lamp holder includes a central through hole and the lamp bead is disposed in the central through hole. The at least two light-emitting elements and the circuit board are disposed in the second housing. The at least two light-emitting elements each include a head tilted with respect to the axial direction of the flame head. The power source is electrically connected to the circuit board.

11 Claims, 4 Drawing Sheets

FLAMELESS CANDLE

CROSS-REFERENCE TO RELATED APPLICATIONS

Pursuant to 35 U.S.C. § 119 and the Paris Convention Treaty, this application claims foreign priority to Chinese Patent Application No. 202010737946.1 filed Jul. 28, 2020, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to a flameless candle.

A candle includes an ignitable wick embedded in wax. When the wick is lighted, the wax is melted and vaporized, and the candle begins to burn and an open flame is produced. This may cause fire hazard.

In recent years, the flameless candles have been developed. To simulate the flickering flame, the flameless candles are equipped with complex structures, such as a swingable lamp body, or using two light-emitting elements to shine the flame head alternately. However, the beam angle of the light-emitting elements is inflexible, so that the simulation effect of the flickering flame is unrealistic.

SUMMARY

The disclosure provides a flameless candle that can produce realistic simulation effect of flickering flames.

The flameless candle comprises a first housing, a flame body, a lamp bead, and a power source. The flame body is disposed on one end of the first housing and comprises a lamp holder and a flame head disposed on the lamp holder. The first housing comprises a cavity and the power source is disposed in the cavity. The lamp bead comprises a second housing, at least two light-emitting elements, and a circuit board. The lamp holder comprises a central through hole along the axial direction of the first housing and the lamp bead is disposed in the central through hole; the at least two light-emitting elements and the circuit board are disposed in the second housing; the at least two light-emitting elements each comprise a head tilted with respect to an axial direction of the flame head; the circuit board is configured to control the at least two light-emitting elements to emit lights with varying brightness; and the power source is electrically connected to the circuit board.

The circuit board is configured to output a control signal to control the at least two light-emitting elements to emit lights with irregular varying brightness, and the change frequency of the brightness of the lights of the at least two light-emitting elements is different from one another; and the change cycle of the control signal is 3-10 s.

The circuit board comprises a first end and a second end; the at least two light-emitting elements are electrically connected to the first end of the circuit board; the second end is provided with two guide pillars electrically connected to positive and negative terminals of the power source, respectively.

The one end of the first housing comprises an opening; the upper part of the lamp holder is rotatably disposed in the opening; and the tip of the flame head extends out of the one end of the first housing.

The one end of the first housing is concave; the lamp holder is rotatably disposed in the opening through screw thread whereby the height of the flame head is adjustable; a limit ring is disposed around the lamp holder and below the one end of the first housing.

The at least two light-emitting elements are disposed at an identical horizontal height; and an included angle between the axis of the at least two light-emitting elements and the axial direction of the flame head is 5°-30°.

The second housing comprises a reflector disposed between the at least two light-emitting elements and the circuit board; and the reflector comprises a concave surface.

The second housing comprises a top surface oriented to the flame head; the top surface is a converging surface, and the maximum included angle between two lights respectively transmitted from two end points of the converging surface is 10°-45°.

The flame head is disposed outside the central through hole and comprises an arc surface, and the lamp bead is disposed on the inner side of the arc surface.

The flameless candle further comprises a base and a control switch disposed on the base; the base is detachably disposed on a bottom part of the first housing; the control switch is electrically connected to the power supply.

The following advantages are associated with the flameless candle according to embodiments of the disclosure.

The flameless candle of the disclosure can comprise only one lamp bead vertically disposed in the lamp holder to simulate the flickering effect of flames, thus simplifying the structure of the flameless candle compared with a conventional one, reducing the processing cost of the lamp holder, and facilitating the fixation and replacement of the flame bead.

The flameless candle of the disclosure comprises at least two light-emitting elements which can emit lights with varying brightness, and the frequency of the light emission, i.e. the change cycle of the light brightness, is irregular, thus improving the simulation effect of flickering flames.

Figure 1:
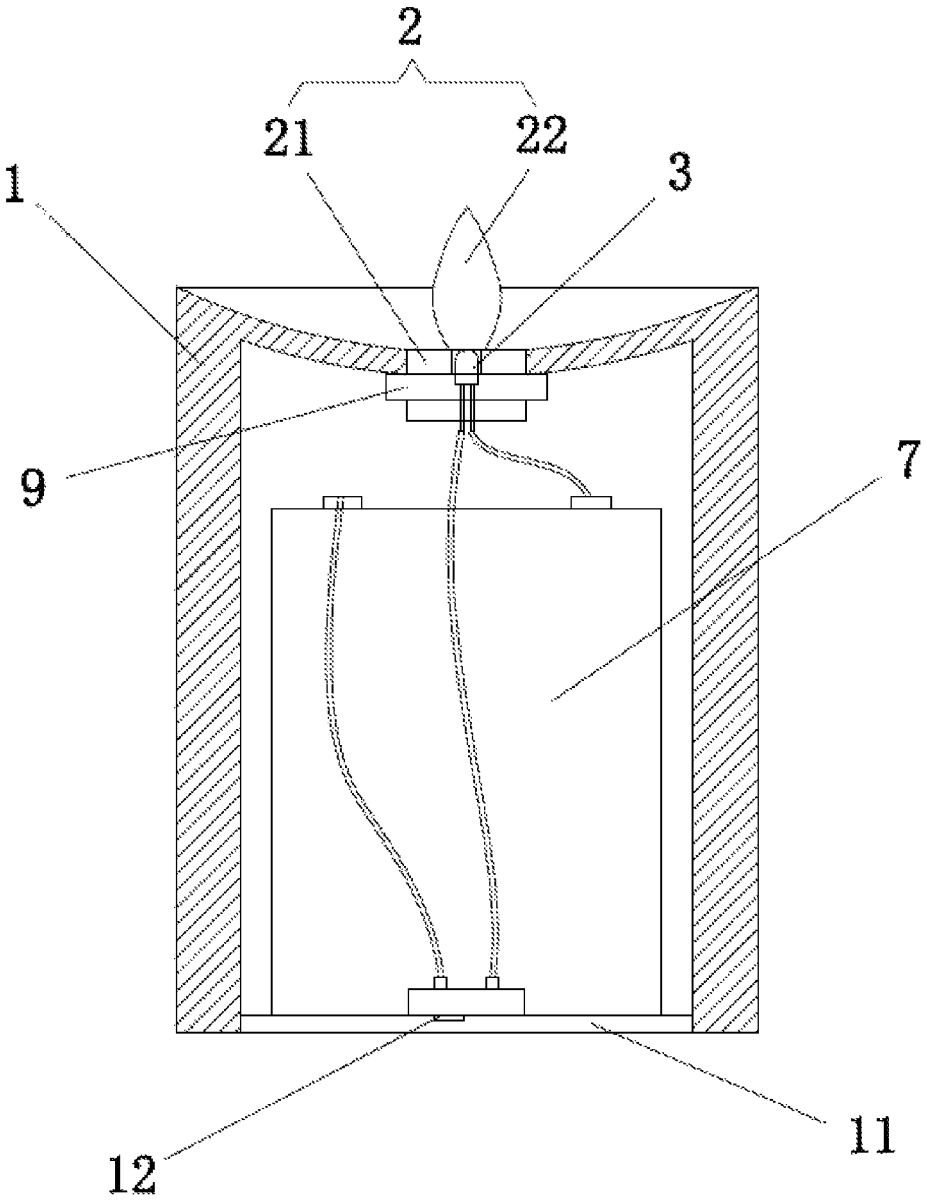
FIG. 1 is an exploded view of a flameless candle according to one embodiment of the disclosure.

In the drawings, the following reference numbers are used: 1. First housing; 2. Flame body; 21. Lamp holder; 22. Flame head; 3. Lamp bead; 4. Second housing; 5. Light-emitting element; 51. First light-emitting element; 52. Second light-emitting element; 6. Circuit board; 7. Power source; 8. Guide pillar; 9. Limit ring; 10. Reflector; 11. Base; 12. Control switch.

DETAILED DESCRIPTION

To further illustrate, embodiments detailing a flameless candle are described below. It should be noted that the following embodiments are intended to describe and not to limit the disclosure.

As shown in FIGS. 1-4, the disclosure provides a flameless candle comprising a first housing 1, a flame body 2, and a lamp bead 3. The flame body 2 is fixed on one end of the first housing 1. The flame body 2 comprises a lamp holder 21 and a flame head 22 disposed on the lamp holder 21. The lamp holder 21 comprises a central through hole along the axial direction of the first housing and the lamp bead is disposed in the central through hole. In this example, the flameless candle comprises one lamp bead. The lamp bead comprises a second housing 4, at least two light-emitting elements 5 and a circuit board 6. The at least two light-emitting elements 5 and the circuit board 6 are disposed in the second housing 4. The at least two light-emitting elements each comprise a head tilted with respect to an axial direction of the flame head 22. The circuit board 6 is configured to control the at least two light-emitting elements 5 to emit light with varying brightness. The first housing 1 comprises a cavity. A power source 7 is disposed in the lower part of the cavity and is electrically connected to the circuit board 6.

Figure 2:
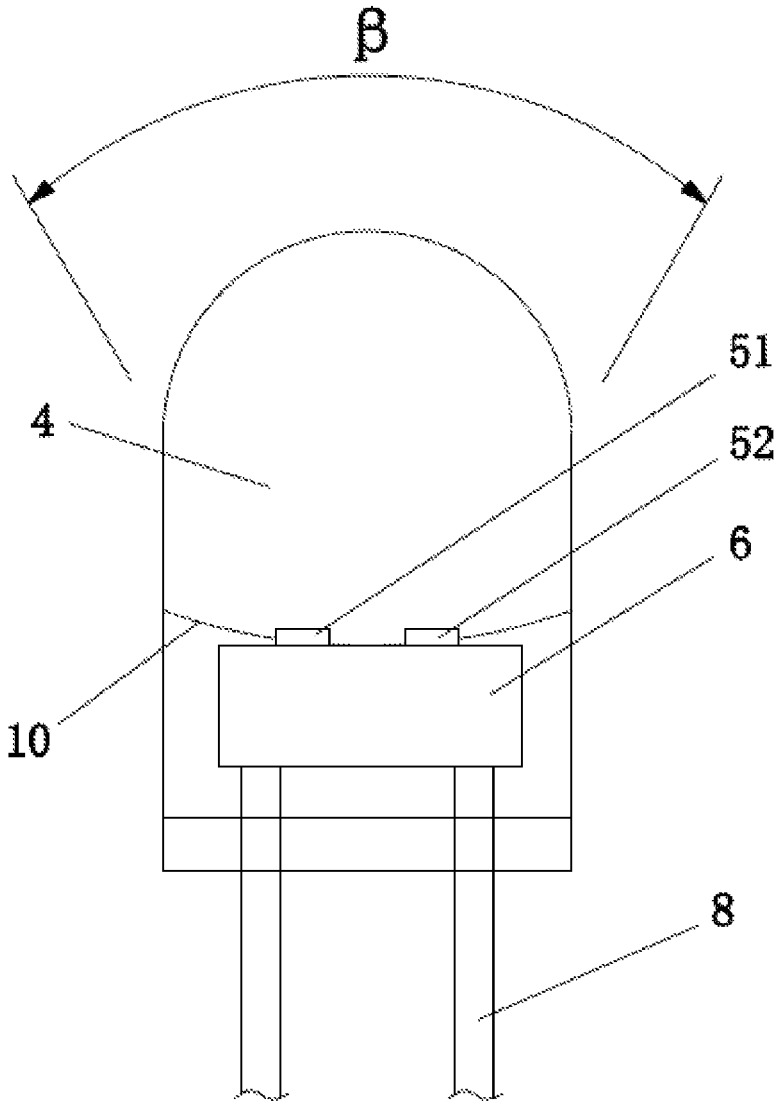
FIG. 2 is a front view of a lamp bead of a flameless candle according to one embodiment of the disclosure.
Figure 3:
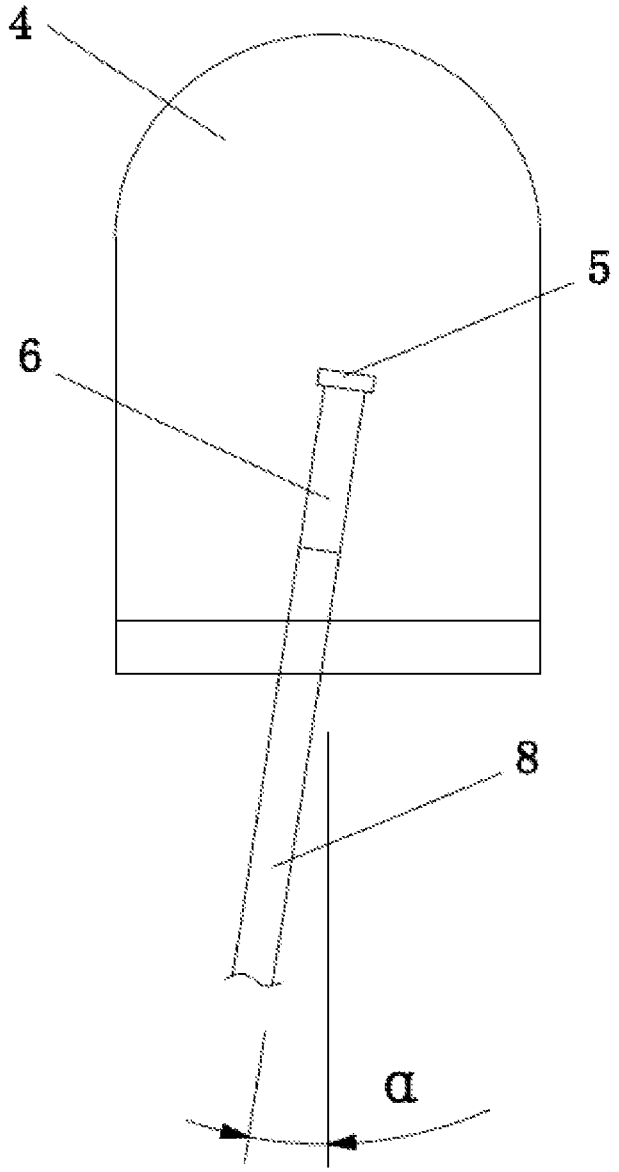
FIG. 3 is a side view of a lamp bead of a flameless candle according to one embodiment of the disclosure.
Figure 4:
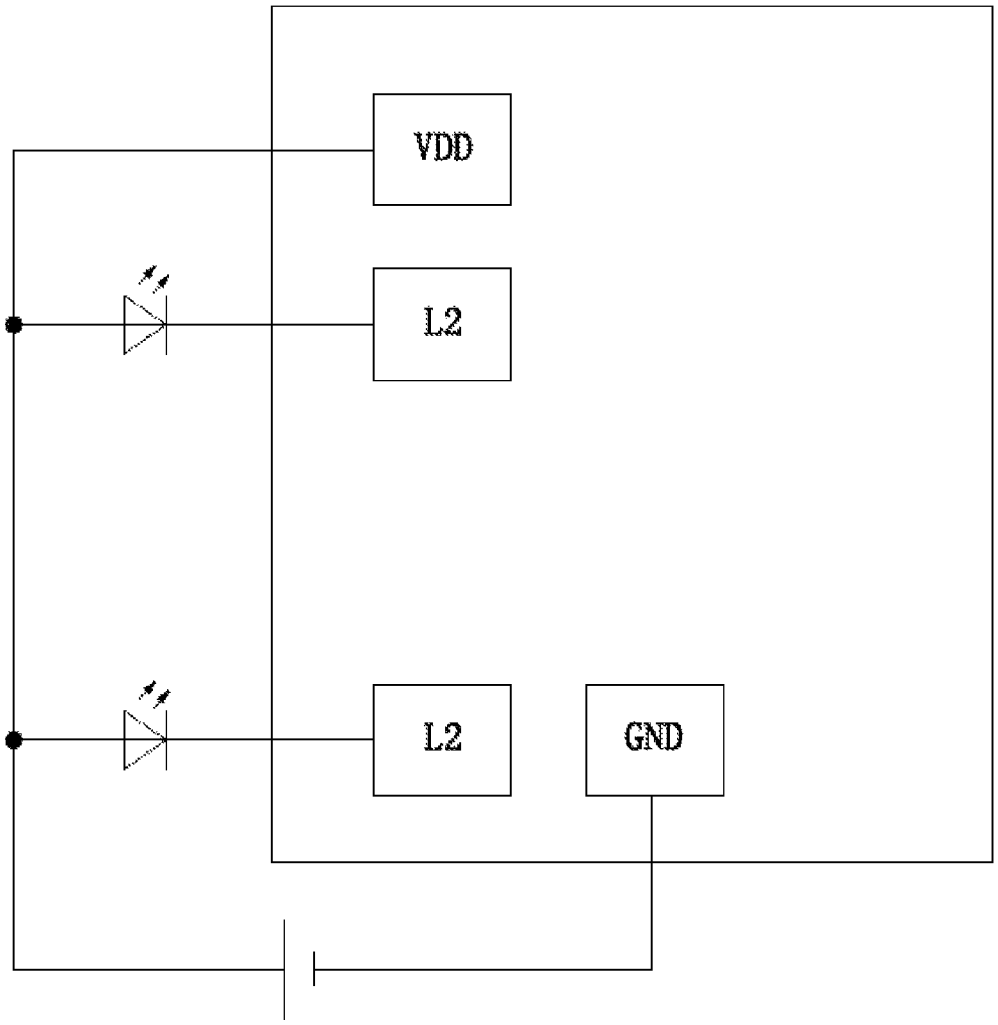
FIG. 4 is a circuit diagram of a circuit board according to one embodiment of the disclosure.

As shown in FIG. 2, the luminous brightness of the at least two light-emitting elements 5 in the lamp bead 3 is variable under the control of the circuit board 6 thereby achieving the flame simulation effect. Optionally, as needed, three light-emitting elements 5 can be disposed in the lamp bead to produce a flickering effect. In the following description, the flameless candle comprises two light-emitting elements 5, that is, a first light-emitting element 51 and a second light-emitting element 52.

In certain examples, the second housing 4 employs a colloidal structure with a transparent cover. In the process of shaping the lamp bead 3, the light-emitting elements are packaged in the colloidal structure using a traditional LED packaging method. For example, epoxy resin can be used for the packaging. The light-emitting elements 5 can emit a monochromatic light including but not limited to white, yellow, blue, or a polychromatic light thereof, thereby obtaining the simulation effect of different colors of a flame.

In certain examples, the circuit board 6 comprises a control chip connected to the first light-emitting element 51 and the second light-emitting element 52 through gold wires. The circuit board 6 outputs a varying current to the first light-emitting element 51 and the second light-emitting element 52 according to a control signal for lighting adjustment, and the first light-emitting element 51 and the second light-emitting element 52 both emit flickering lights.

In certain examples, the circuit board 6 is configured to output a control signal to control the at least two light-emitting elements 5 to emit light with irregular varying brightness; the change frequency of the luminous brightness of the at least two light-emitting elements 5 is different, and the change cycle of the control signal is 3-10 s.

Through the irregular change of luminous brightness, the flickering effect of the flame light is simulated. At the same time, the change frequency of the luminous brightness of each light-emitting element 5 is different from one another, thus realizing the simultaneous flickering effect of a plurality of flame lights, and the simulation effect is more realistic. Although the control signals of different light-emitting elements 5 are different, the overall change cycle of the control signals is designed to be consistent, thus reducing the design cost of the circuits and ensuring the stability of the candle flames.

In certain examples, as shown in FIG. 2, the circuit board 6 comprises a first end and a second end; the at least two light-emitting elements 5 are electrically connected to the first end of the circuit board; the second end is provided with two guide pillars 8 electrically connected to positive and negative terminals of the power source 7.

In certain examples, as shown in FIG. 1, the one end of the first housing comprises an opening; the upper part of the lamp holder 21 is rotatably disposed in the opening; and the tip of the flame head 22 extends out of the one end of the first housing. In this way, the dynamic effect of the candle light can be observed directly without affecting the lighting and condensation effect of the candle light.

In certain examples, the one end of the first housing is concave; the lamp holder 21 is rotatably disposed in the opening through screw thread whereby the height of the flame head 22 is adjustable; a limit ring 9 is disposed around the lamp holder 21 and below the one end of the first housing.

Through the threaded connection of the flame body in the opening, the height of the flame body 2 can be adjusted, and then the lamp head 22 can ascend or descend in the vertical direction. As needed, a user can adjust the height of the lamp head 22, so as to control the illumination brightness of the entire simulated flame extending out of the first housing 1, thus exhibiting realistic visual atmosphere of the candle light. The limit ring 9 can prevent the flame body 2 from detaching from the first housing 1 caused by the excessive rotation of the flame body 2. At the same time, the arrangement of the limit ring can ensure that the highest point of the bottom of the lamp head 22 cannot exceed the highest top surface of the first housing 1 during the adjustment process of the lamp head, thus ensuring the authenticity of the flame combustion, and preventing the visual separation and disconnection between the candle light and the flame body.

In certain examples, as shown in FIG. 1, the at least two light-emitting elements 5 are disposed at an identical horizontal height; and the included angle between the axis of the at least two light-emitting elements 5 and the axial direction of the flame head is 5°-30°. In the related art, the entire lamp bead is tilted with respect to the flame head. Thus, the base 11 of the flame body 2 is provided with a plurality of tilted openings for accommodating corresponding lamp beads. The openings are of special-shaped structure and have relatively large area, which is not conducive to the adjustment and fixation of the flame body 2. In this disclosure, the lamp bead 3 is vertically disposed, and the head of the at least two light-emitting elements 5 is tilted with respect to the lamp head 22 and a certain angle is formed between the head and the vertical plane. The design ensures the light can reach the flame head 22, simplifies the structure of the flame body 2 compared with a conventional one, saves the processing cost, and facilitates the adjustment and fixation of the flame body 2.

In another example, the flameless candle comprises at least three light-emitting elements 5, and the axis thereof and the axial direction of the flame head form an included angle of 5°-30°. The at least three light-emitting elements 5 are not in the same horizontal height, and are disposed in different vertical heights. For example, two light-emitting elements 5 are disposed higher than the rest one light-emitting element 5. The upper and lower light-emitting elements 5 can emit different colors of light. For example, the lower light-emitting element 5 emits a blue light, while the upper light-emitting elements 5 emit yellow lights. In this way, the internal and external flames of a flame can be simulated. Optionally, different colors of the light-emitting elements can be arranged to form multi-color and create different lighting effects.

In certain examples, the second housing 4 comprises a reflector 10 disposed between the at least two light-emitting elements 5 and the circuit board 6; and the reflector 10 comprises a concave surface. The reflector 10 can be an aluminum sheet, an aluminum foil, or an electroplated metal layer. The design improves the concentrating effect and ensures the luminous brightness of the flameless candle.

In certain examples, the top surface of the second housing 4 is a converging surface, and the maximum included angle β between two lights respectively transmitted from two end points of the converging surface is 10°-45°. Controlling the angle of the emitted lights is to concentrate the lights within the contour range of the flame head 22, so that the brightness of the lights is more concentrated and a more realistic flame can be produced.

In certain examples, the flame head 22 is disposed outside the central through hole and comprises an arc surface, and the lamp bead 3 is disposed on the one side of the arc surface. In this way, the lights emitted from the lamp bead 3 can be concentrated in the frame head, thus improving the light intensity and producing realistic flame brightness.

In certain examples, a base 11 is detachably disposed on the bottom part of the first housing 1; the base 11 is provided with a control switch 12 electrically connected to the power supply 7. In this way, the replacement of the power supply 7 and the lamp bead 3 is simplified.

The working principle of the flameless candle is detained as follows. When in use, the control switch 12 on the base 11 of the bottom part of the first housing 1 is turned on, and the power supply 7 supplies power to the circuit board 6 through the two guide pillars 8 electrically connected to the positive and negative terminals of the power source 7. The independent control chips on the circuit board 6 respectively transmit the light control signals of the light-emitting elements 5, so that while the light-emitting elements 5 are in the luminous state, the luminous intensity thereof is changed intermittently under the control of the light control signals, thus producing the flickering effect. In addition, the light control signals can control different light-emitting elements 5 to emit lights with different brightness changes according to varying frequencies. The lights with various brightness changes shine on the lamp head 22, to produce realistic flickering effect of the flames.

The flameless candle of the disclosure can comprise only one lamp bead vertically disposed in the lamp holder to simulate the flickering effect of flames, thus simplifying the structure of the flameless candle compared with a conventional one, reducing the processing cost of the lamp holder 21, and facilitating the fixation and replacement of the flame bead.

The flameless candle of the disclosure comprises at least two light-emitting elements 5 which can emit lights with varying brightness, and the frequency of the light emission, i.e. the change cycle of the light brightness, is irregular, thus improving the simulation effect of flickering flames.

It will be obvious to those skilled in the art that changes and modifications may be made, and therefore, the aim in the appended claims is to cover all such changes and modifications.

What is claimed is:

1. A device, comprising:

1) a first housing comprising a cavity;

2) a flame body disposed on one end of the first housing, the frame body comprising a lamp holder and a flame head disposed on the lamp holder;

3) a lamp bead comprising a second housing, at least two light-emitting elements, and a circuit board; and 4) a power source disposed in the cavity;

wherein:

the lamp holder comprises a central through hole along an axial direction of the first housing and the lamp bead is disposed in the central through hole;

the at least two light-emitting elements and the circuit board are disposed in the second housing;

the at least two light-emitting elements each comprise a head tilted with respect to an axial direction of the flame head;

the circuit board is configured to control the at least two light-emitting elements to emit lights with varying brightness;

the power source is electrically connected to the circuit board;

the circuit board comprises a first end and a second end; the at least two light-emitting elements are electrically connected to the first end; the second end is provided with two guide pillars electrically connected to positive and negative terminals of the power source, respectively;

the one end of the first housing comprises an opening; an upper part of the lamp holder is rotatably disposed in the opening; and a tip of the flame head extends out of the one end of the first housing; and the one end of the first housing is concave; the lamp holder is rotatably disposed in the opening through screw thread whereby a height of the flame head is adjustable; a limit ring is disposed around the lamp holder and below the one end of the first housing.

2. The device of claim 1, wherein the at least two light-emitting elements are disposed at an identical horizontal height; and an included angle between an axis of the at least two light-emitting elements and the axial direction of the flame head is 5°-30°.

3. The device of claim 2, wherein the second housing comprises a top surface oriented to the flame head; and the top surface is a converging surface.

4. The device of claim 3, wherein the flame head is disposed outside the central through hole and comprises an arc surface, and the lamp bead is disposed on an inner side of the arc surface.

5. The device of claim 4, wherein the device further comprises a base and a control switch disposed on the base; the base is detachably disposed on a bottom part of the first housing; the control switch is electrically connected to the power supply.

6. The device of claim 2, wherein the second housing comprises a reflector disposed between the at least two light-emitting elements and the circuit board; and the reflector comprises a concave surface.

7. The device of claim 1, wherein the second housing comprises a reflector disposed between the at least two light-emitting elements and the circuit board; and the reflector comprises a concave surface.

8. The device of claim 1, wherein the second housing comprises a top surface oriented to the flame head; and the top surface is a converging surface.

9. The device of claim 8, wherein the flame head is disposed outside the central through hole and comprises an arc surface, and the lamp bead is disposed on an inner side of the arc surface.

10. The device of claim 1, wherein the device further comprises a base and a control switch disposed on the base; the base is detachably disposed on a bottom part of the first housing; the control switch is electrically connected to the power supply.

11. A device, comprising:

1) a first housing comprising a cavity;

2) a flame body disposed on one end of the first housing, the frame body comprising a lamp holder and a flame head disposed on the lamp holder;

3) a lamp bead comprising a second housing, at least two light-emitting elements, and a circuit board; and 4) a power source disposed in the cavity;

wherein:

the lamp holder comprises a central through hole along an axial direction of the first housing and the lamp bead is disposed in the central through hole;

the at least two light-emitting elements and the circuit board are disposed in the second housing;

the at least two light-emitting elements each comprise a head tilted with respect to an axial direction of the flame head;

the circuit board is configured to control the at least two light-emitting elements to emit lights with varying brightness;

the power source is electrically connected to the circuit board;

the circuit board is configured to output a control signal to control the at least two light-emitting elements to emit lights with irregular varying brightness, and a change frequency of the brightness of the lights of the at least two light-emitting elements is different from one another; and a change cycle of the control signal is 3-10 s;

the circuit board comprises a first end and a second end; the at least two light-emitting elements are electrically connected to the first end; the second end is provided with two guide pillars electrically connected to positive and negative terminals of the power source, respectively;

the one end of the first housing comprises an opening; an upper part of the lamp holder is rotatably disposed in the opening; and a tip of the flame head extends out of the one end of the first housing; and the one end of the first housing is concave; the lamp holder is rotatably disposed in the opening through screw thread whereby a height of the flame head is adjustable; a limit ring is disposed around the lamp holder and below the one end of the first housing.

* * * * *